US012025116B2

(12) United States Patent
Kodama

(10) Patent No.: US 12,025,116 B2
(45) Date of Patent: Jul. 2, 2024

(54) PUMP APPARATUS

(71) Applicant: Murata Manufacturing Co., Ltd., Kyoto (JP)

(72) Inventor: Yukiharu Kodama, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 163 days.

(21) Appl. No.: 17/661,774

(22) Filed: May 3, 2022

(65) Prior Publication Data

US 2022/0260068 A1 Aug. 18, 2022

Related U.S. Application Data

(63) Continuation of application No. PCT/JP2020/039852, filed on Oct. 23, 2020.

(30) Foreign Application Priority Data

Dec. 26, 2019 (JP) ..... 2019-235444

(51) Int. Cl.
*F04B 43/04* (2006.01)
*F04B 45/10* (2006.01)

(52) U.S. Cl.
CPC ..... *F04B 43/046* (2013.01); *F04B 45/10* (2013.01)

(58) Field of Classification Search
CPC ..... F04B 43/046
See application file for complete search history.

(56) References Cited

U.S. PATENT DOCUMENTS 11,770,913 B2 * 9/2023 Mou ..... F04B 43/046 165/80.4
2015/0071797 A1 * 3/2015 Takeuchi ..... F04B 43/0054 417/413.2
2018/0223829 A1 8/2018 Tanaka et al.
2018/0368704 A1 12/2018 Kawamura et al.
(Continued)

FOREIGN PATENT DOCUMENTS

JP 2001-323879 A 11/2001
JP 2007-187026 A 7/2007
(Continued)

OTHER PUBLICATIONS

International Search Report for International Patent Application No. PCT/JP2020/039852 dated Jan. 12, 2021.

*Primary Examiner* — Thomas Fink
(74) *Attorney, Agent, or Firm* — Pearne & Gordon LLP

(57) ABSTRACT

A pump apparatus includes a piezoelectric pump, an outer housing, and an adhesive sheet. The piezoelectric pump has a principal surface at which a discharge port for a fluid is formed. The outer housing has a housing channel that communicates with the discharge port, and the outer housing is formed at least partially using a resin having water-containing properties. The adhesive sheet adheres the principal surface of the piezoelectric pump to the outer housing. The outer housing includes a main plate. The main plate has a principal surface that opposes the principal surface of the piezoelectric pump and is in contact with the adhesive sheet. The main plate also has a through-hole that communicate with the discharge port and with the housing channel. The principal surface is formed as a surface of a metal portion.

20 Claims, 3 Drawing Sheets

(56) References Cited

U.S. PATENT DOCUMENTS

| | | | | |
|---|---|---|---|---|
| 2019/0328324 | A1 | 10/2019 | Mizuno et al. | |
| 2020/0318630 | A1 | 10/2020 | Kondo et al. | |
| 2023/0286273 | A1* | 9/2023 | Kondo | B41J 2/14233 |

FOREIGN PATENT DOCUMENTS

| | | | |
|---|---|---|---|
| JP | 2018-143557 | A | 9/2018 |
| WO | 2017/061349 | A1 | 4/2017 |
| WO | 2018/021099 | A1 | 2/2018 |
| WO | 2019/124060 | A1 | 6/2019 |

* cited by examiner

PUMP APPARATUS

CROSS REFERENCE TO RELATED APPLICATION

This is a continuation of International Application No. PCT/JP2020/039852 filed on Oct. 23, 2020 which claims priority from Japanese Patent Application No. 2019-235444 filed on Dec. 26, 2019. The contents of these applications are incorporated herein by reference in their entireties.

BACKGROUND OF THE DISCLOSURE

Field of the Disclosure

The present disclosure relates to a pump apparatus that includes a pump and an outer housing that communicates with the pump.

Description of the Related Art

Patent Document 1 describes a sphygmomanometer using a piezoelectric pump. The sphygmomanometer of Patent Document 1 includes an inner case member. The inner case member is made of a synthetic resin.

The piezoelectric pump has a surface at which a discharge port is formed, and the surface and the inner case are adhered to each other.

Patent Document 1: Japanese Unexamined Patent Application Publication No. 2018-143557

BRIEF SUMMARY OF THE DISCLOSURE

In the case of the inner case member being made of a resin that contains water, if the temperature of the inner case member increases, for example, the water contained in the resin evaporates and may reach to the adhesion surface adhered to the piezoelectric pump.

There may arise a problem that the piezoelectric pump comes off from the inner case member due to the presence of the water at the adhesion surface of the inner case member.

Accordingly, the present disclosure provides a fluid control apparatus that can reduce the deterioration of the adhesion between a pump and a housing even if the housing is made of a material having water-containing properties.

A pump apparatus according to the present disclosure includes a pump, an outer housing, and an adhesive member. The pump has a discharge-port surface at which a discharge port for a fluid is formed. The outer housing has an internal space that communicates with the discharge port, and the outer housing is formed at least partially using a resin having water-containing properties. The adhesive member adheres the discharge-port surface of the pump to the outer housing. The outer housing includes a first main plate. The first main plate has a first principal surface that opposes the discharge-port surface of the pump and is in contact with the adhesive member. The first main plate also has a through-hole that communicate with the discharge port and also with the internal space. The first principal surface is made of a metal.

With this configuration, even if the temperature of the outer housing increases, the water contained in the resin is not exposed at the first principal surface due to the presence of the metal. Accordingly, the water contained in the resin does not affect the adhesion between the first principal surface and the adhesive member.

According to the present disclosure, the deterioration of the adhesion between the housing and the pump can be reduced even if the housing is made of a material having water-containing properties.

DETAILED DESCRIPTION OF THE DISCLOSURE

First Embodiment

Figure 1:
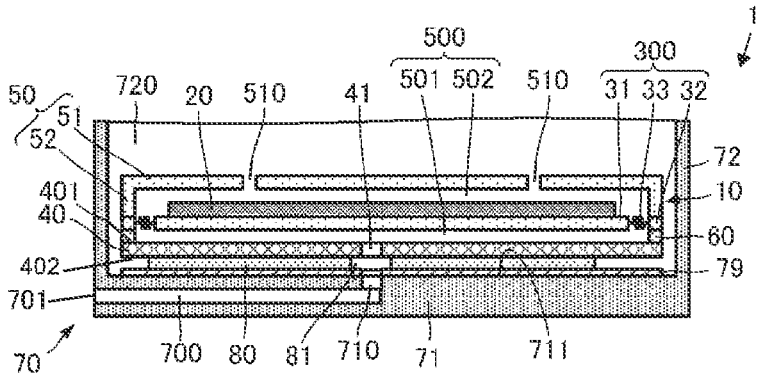
FIG. 1 is a cross-sectional side view illustrating a structure of a pump apparatus according to a first embodiment of the present disclosure.
Figure 2:
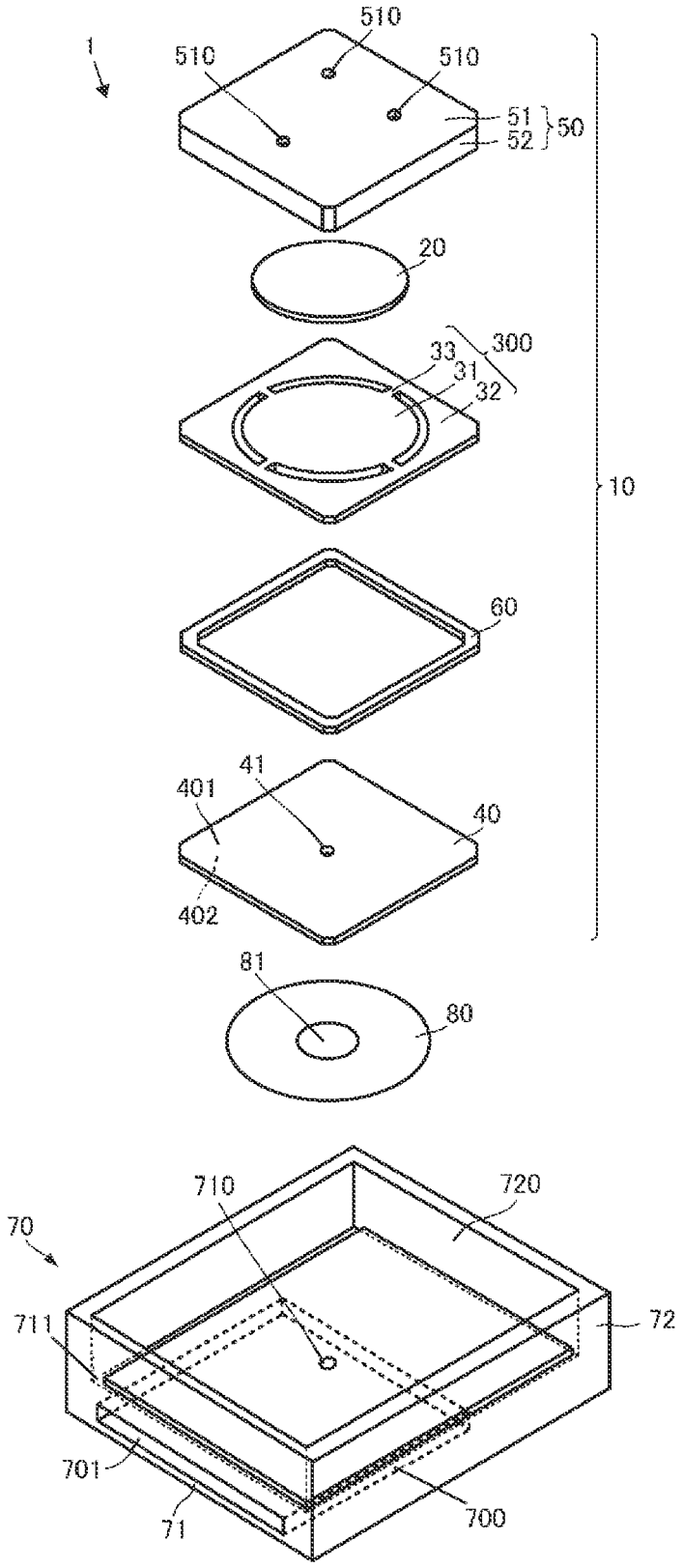
FIG. 2 is an exploded perspective view illustrating the pump apparatus according to the first embodiment of the present disclosure.

A pump apparatus according to a first embodiment of the present disclosure will be described with reference to the drawings. FIG. 1 is a cross-sectional side view illustrating a structure of the pump apparatus according to the first embodiment of the present disclosure. FIG. 2 is an exploded perspective view illustrating the pump apparatus according to the first embodiment of the present disclosure. In the drawings that illustrate embodiments including the present one, shapes (dimensions) of elements are illustrated in a partially or entirely exaggerated manner to facilitate better understanding.

As illustrated in FIGS. 1 and 2, a pump apparatus 1 includes a piezoelectric pump 10, an outer housing 70, and an adhesive sheet 80. The adhesive sheet 80 corresponds to an "adhesive member" of the present disclosure. The piezoelectric pump 10 is adhered to the outer housing 70 by the adhesive sheet 80. Here, a discharge port 41 of the piezoelectric pump 10 communicates with a through-hole 710 of the outer housing 70 through a central opening 81 of the adhesive sheet 80.

Structure of Piezoelectric Pump 10

The piezoelectric pump 10 includes a piezoelectric element 20, a flat-plate member 300 having a diaphragm 31, a first housing member 40, a second housing member 50, and a third housing member 60.

The piezoelectric element 20 is formed of a disk-like piezoelectric body and electrodes for actuating the piezoelectric body. The electrodes are formed on respective principal surfaces of the disk-like piezoelectric body.

The flat-plate member 300 includes the diaphragm 31, a base portion 32, and support portions 33. The flat-plate member 300 is a flat plate made, for example, of a metal. The flat-plate member 300 is shaped like a rectangle as viewed in plan. A surface that can be viewed in plan is a principal surface of the flat-plate member 300. For example, the flat-plate member 300 is made from a single flat plate. In other words, the diaphragm 31, the base portion 32, and support portions 33 are integrally formed from a single flat plate. The diaphragm 31 is shaped like a disk. The base portion 32 is shaped so as to surround the diaphragm 31. The support portions 33 connect the diaphragm 31 to the base portion 32. The support portions 33 connect the outer periphery of the diaphragm 31 to the base portion 32 locally at multiple positions. The diaphragm 31 is thereby supported by the base portion 32 so as to be able to vibrate.

The first housing member 40 is a flat plate made, for example, of a metal. The material of the first housing member 40 may be any material that at least has a predetermined rigidity. The first housing member 40 is shaped like a rectangle as viewed in plan. A surface that can be viewed in plan is a principal surface of the first housing member 40. The first housing member 40 has a principal surface 401 and a principal surface 402 that are positioned opposite to each other. The principal surface 402 corresponds to a "discharge-port surface" of the present disclosure.

The first housing member 40 has a discharge port 41. When the piezoelectric pump 10 is viewed in plan, the discharge port 41 overlaps, for example, a central portion of the diaphragm 31. The discharge port 41 is a through-hole that pierces the first housing member 40 between the principal surfaces 401 and 402, in other words, that pierces the first housing member 40 in the thickness direction thereof. The discharge port 41 is shaped cylindrically.

The second housing member 50 is shaped like a box having a main plate 51 and a frame 52. The second housing member 50 is made, for example, of a metal. The main plate 51 is shaped like a flat plate. More specifically, the main plate 51 is shaped like a rectangle as viewed in plan and has substantially the same shape and area as those of the first housing member 40. The frame 52 extends in a direction orthogonal to the principal surface of the main plate 51. The frame 52 is formed along the peripheral edges of the main plate 51. Thus, the second housing member 50 is formed into a box. The main plate 51 and the frame 52 may be formed independently or may be formed integrally.

The main plate 51 has multiple intake ports 510 formed therein. The intake ports 510 are through-holes that pierce the main plate 51 between the opposite principal surfaces, in other words, that pierces the main plate 51 in the thickness direction. Each of the intake ports 510 is shaped cylindrically.

The third housing member 60 is a frame having a predetermined thickness. The peripheral shape of the third housing member 60 is substantially the same as that of the first housing member 40.

The third housing member 60 is connected to one of the principal surfaces of the first housing member 40. The base portion 32 of the flat-plate member 300 is connected to the third housing member 60. The frame 52 of the second housing member 50 is connected to the base portion 32 of the flat-plate member 300. Thus, a pump housing having a space 500 therein is formed.

The diaphragm 31 divides the space 500 into a space 501 and a space 502. With respect to the diaphragm 31, the space 501 is positioned near the discharge port 41, and the space 502 is positioned near the intake ports 510. The space 501 and the space 502 are in communication with each other through through-holes that are formed at the support portions 33 and that pierce the flat-plate member 300.

The piezoelectric element 20 is disposed on the principal surface of the diaphragm 31 that faces the space 502.

The piezoelectric pump 10 configured as above transports a fluid. Note that the principle of transporting the fluid has been disclosed in previous applications by the present inventors and is already known. Accordingly, a simplified explanation will be provided here.

The piezoelectric element 20 is connected to a control unit (not illustrated). The control unit generates an AC voltage and applies it to the piezoelectric element 20. This causes the piezoelectric element 20 to expand and contract and thereby causes the diaphragm 31 to vibrate flexurally. This changes the volume of the spaces 501 and 502. As a result, the piezoelectric pump 10 takes the fluid therein through the intake ports 510 and discharges the fluid out through the discharge port 41.

Outer Housing 70

The outer housing 70 illustrated in FIGS. 1 and 2 is mainly made of a resin that is excellent in moldability. An example of the resin is polycarbonate resin or ABS resin.

The outer housing 70 includes a main plate 71 and side plates 72. The main plate 71 is shaped like a flat plate having a principal surface 711. The side plates 72 are shaped like a frame. The side plates 72 are connected to the principal surface 711 of the main plate 71. For example, the outer housing 70 is integrally formed of a resin.

The outer housing 70 has an internal space 720 defined by the main plate 71 and the side plates 72. The outer housing 70 corresponds to a "fixation member" of the present disclosure. The main plate 71 corresponds to a "first principal surface" of the present disclosure. The internal space 720 corresponds to a "first space" of the present disclosure. The piezoelectric pump 10 is disposed in the internal space 720.

For example, a flat plate (not illustrated) or the like is disposed in the internal space 720 at a position opposite to the main plate 71 and is connected to the side plates 72, which enables the internal space 720 of the outer housing 70 to be separated from the external space.

The main plate 71 has a housing channel 700. The housing channel 700 is formed inside the main plate 71. The housing channel 700 corresponds to a "second space" of the present disclosure.

The main plate 71 has an external discharge opening 701. The external discharge opening 701 opens at one side surface of the main plate 71. The external discharge opening 701 communicates with the housing channel 700.

The main plate 71 has the through-hole 710. The through-hole 710 opens at the principal surface 711 and communicates with the housing channel 700. The through-hole 710 is shaped cylindrically. The cross-sectional area of the through-hole 710 is substantially equal to the cross-sectional area of the discharge port 41 of the piezoelectric pump 10.

The principal surface 711 of the main plate 71 is formed as a surface of a metal portion 79. More specifically, the metal portion 79 is a portion of the main plate 71 being present to a predetermined depth from the principal surface 711. The metal portion 79 covers the main plate 71 substantially entirely at the principal surface 711. The metal portion 79 is formed as a film using vapor deposition, sputtering, plating, or the like. The metal portion 79 is made of a material that contains, for example, at least one of aluminum (Al), copper (Cu), iron (Fe), nickel (Ni), chromium (Cr), tin (Zn), titan (Ti), and gold (Au). For example, the thickness of the metal portion 79 is approximately 10 nm to 1 μm or more.

Structure of Adhesive Sheet 80

As illustrate in FIGS. 1 and 2, the adhesive sheet 80 has a predetermined thickness and is shaped like an annular ring having a circular central opening 81. The opening area of the central opening 81 is larger than the cross-sectional area of the discharge port 41 of the piezoelectric pump 10 and also larger than the cross-sectional area of the through-hole 710 of the outer housing 70. The outer diameter of the adhesive sheet 80 is set to be equal to or less than the length of one side of the first housing member 40 of the piezoelectric pump 10.

The adhesive sheet 80 is a so-called double-sided adhesive sheet formed, for example, of an acrylic adhesive sheet or a silicone adhesive sheet. The adhesive sheet 80 may be formed so as to have, or so as not to have, an intermediate resin layer.

Adhesion Between Piezoelectric Pump 10 and Outer Housing 70 Using Adhesive Sheet 80

One principal surface of the adhesive sheet 80 is in contact with, and adhered to, the principal surface 402 of the first housing member 40 of the piezoelectric pump 10. The other principal surface of the adhesive sheet 80 is in contact with, and adhered to, the principal surface 711 of the main plate 71 of the outer housing 70. The piezoelectric pump 10 is thereby adhered to the outer housing 70.

Here, the adhesive sheet 80 is disposed such that the central opening 81 of the adhesive sheet 80 is superposed on the discharge port 41 of the first housing member 40 of the piezoelectric pump 10 and also on the through-hole 710 of the main plate 71 of the outer housing 70. As a result, the discharge port 41 of the piezoelectric pump 10 communicates with the through-hole 710 of the outer housing 70 through the central opening 81 of the adhesive sheet 80.

Advantageous Effects of Pump Apparatus 1

The piezoelectric pump 10 configured as above generates heat due to the diaphragm 31 vibrating. The heat is transmitted to the outer housing 70 via the adhesive sheet 80, which increases the temperature of the outer housing 70. When the temperature of the outer housing 70 increases, water contained in the resin evaporates and escapes out of the outer housing 70.

The pump apparatus 1 is configured such that the surface of the metal portion 79 serves as the principal surface 711 of the main plate 71, which is the adhesion surface adhered to the adhesive sheet 80. The metal portion 79 prevents water from passing therethrough, and no water comes out on the principal surface 711.

This reduces the likelihood of water coming out to the adhesion surface of the adhesive sheet 80 adhered to the outer housing 70, thereby reducing the deterioration of the adhesion between the adhesive sheet 80 and the principal surface 711.

The pump apparatus 1 is configured such that the area of the principal surface 711 is larger than the area of the adhesive sheet 80 (the area of the adhesion surface between the principal surface 711 and the adhesive sheet 80). This reduces the likelihood of water escaping out of portions of the outer housing 70 that are not covered with the metal portion 79 and reaching the adhesion surface of the adhesive sheet 80. This further reduces the deterioration of the adhesion between the principal surface 711 and the adhesive sheet 80. In addition, this facilitates thermal diffusion from the principal surface 711 and readily radiates the heat produced by the piezoelectric pump 10. The metal portion 79 is disposed at least over the adhesion surface of the principal surface 711 adhered to the adhesive sheet 80. Accordingly, the metal portion 79 is preferably larger than the area of the adhesion surface.

The pump apparatus 1 is configured such that the area of the principal surface 402 of the first housing member 40 is larger than the area of the adhesive sheet 80 (the area of the adhesion surface between the principal surface 402 and the adhesive sheet 80). According to this configuration, as illustrated in FIG. 1, the adhesive sheet 80 is not in contact with, and not adhered to, corner portions of the first housing member 40. In other words, the adhesive sheet 80 is not in contact with, and not adhered to, portions of the first housing member 40 that are positioned furthest away from the center of vibration. This reduces the likelihood of the vibrations of the diaphragm 31 escaping to the outer housing 70, which can improve the efficiency of vibration of the piezoelectric pump 10. This advantageous effect is obtained not only in the case where the piezoelectric pump 10 is shaped like a rectangle as viewed in plan but also in the case where the piezoelectric pump 10 is shaped like other polygons. Moreover, according to this configuration, the adhesion area of the adhesive sheet 80 between the first housing member 40 and the outer housing 70 can be reduced. Accordingly, the amount of heat transmitted from the first housing member 40 to the outer housing 70 can be reduced, which can reduce the temperature increase of the outer housing 70.

The pump apparatus 1 is configured such that the adhesive sheet 80 is shaped in advance. Accordingly, when the piezoelectric pump 10 is adhered to the outer housing 70, the shape of the central opening 81 can be maintained easily. On the other hand, it is possible to use, for example, a liquid-type adhesive having thermosetting or UV curing properties. It is not easy, however, to form the central opening 81 into a predetermined shape, which may disrupt the communication between the discharge port 41 and the through-hole 710. Accordingly, the pump apparatus 1 configured to have the adhesive sheet 80 can be produced more reliably and easily.

With this configuration, it is not necessary to provide a nozzle that protrudes outward at the discharge port 41 of the piezoelectric pump 10. Thus, the pump apparatus 1 can be made thin.

In the pump apparatus 1, the discharge port 41 is in communication with the housing channel 700 in the outer housing 70. According to the above-described configuration, it is possible to form the pump apparatus 1 in such a manner that the intake ports 510 communicate with the housing channel 700 of the outer housing 70. In this case, however, the temperature of a fluid (for example, air) discharged from the discharge port 41 increases compared with the fluid taken in through the intake ports 510. Accordingly, the advantageous effects of the pump apparatus 1 can be obtained more effectively in the configuration in which the discharge port 41 is in communication with the housing channel 700 of the outer housing 70.

Even if the outer housing 70 is made of other resins having water-containing properties, the advantageous effects described above can be also obtained in the pump apparatus configured as described above. The percentage of water absorption is an indicator of the water-containing properties. Especially when the percentage of water absorption of a resin is, for example, 0.15 or more, the advantageous effects of the present disclosure can be obtained more effectively.

In the above description, the discharge port is the port communicating with the outer housing 70. The port communicating with the outer housing 70, however, can be used as the intake port, and the above-described intake ports can be used as the discharge port.

Second Embodiment

Figure 3:
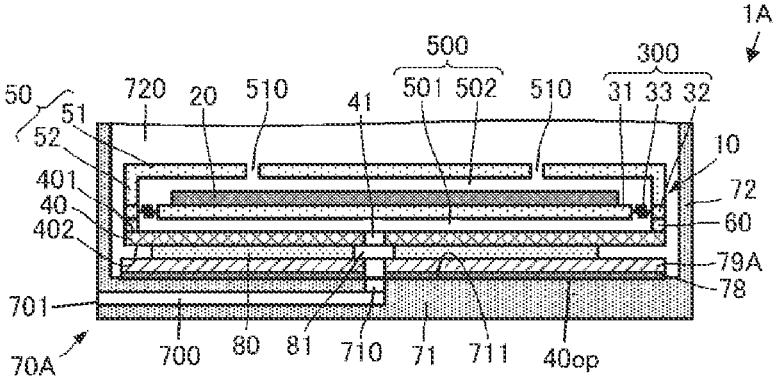
FIG. 3 is a cross-sectional side view illustrating a structure of a pump apparatus according to a second embodiment of the present disclosure.

A pump apparatus according to a second embodiment of the present disclosure will be described with reference to the drawings. FIG. 3 is a cross-sectional side view illustrating a structure of the pump apparatus according to the second embodiment of the present disclosure.

As illustrated in FIG. 3, a pump apparatus 1A according to the second embodiment is different from the pump apparatus 1 of the first embodiment in that the pump apparatus 1A includes a metal portion 79A and a metal-adhesive member 78. Other configurations of the pump apparatus 1A are the same as those of the pump apparatus 1, and duplicated explanations will be omitted.

The metal portion 79A and the metal-adhesive member 78 are included in an outer housing 70A. The metal portion 79A is joined to the principal surface 711 of the main plate 71 using the metal-adhesive member 78.

The metal portion 79A is shaped like a flat plate and formed independently of the outer housing 70A. For example, the metal-adhesive member 78 is an adhesive having thermosetting or ultraviolet curing properties.

The main plate 71 has the metal portion 79A at the principal surface 711. Accordingly, as is the case for the pump apparatus 1, the pump apparatus 1A can reduce the likelihood of water reaching the adhesion surface of the adhesive sheet 80, thereby reducing the deterioration of the adhesion between the principal surface 711 and the adhesive sheet 80.

Third Embodiment

Figure 4:
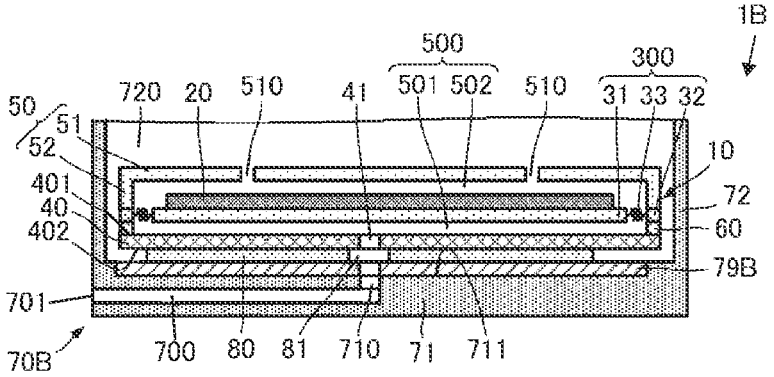
FIG. 4 is a cross-sectional side view illustrating a structure of a pump apparatus according to a third embodiment of the present disclosure.

A pump apparatus according to a third embodiment of the present disclosure will be described with reference to the drawings. FIG. 4 is a cross-sectional side view illustrating a structure of the pump apparatus according to the third embodiment of the present disclosure.

As illustrated in FIG. 4, a pump apparatus 1B according to the third embodiment is different from the pump apparatus 1 of the first embodiment in that the pump apparatus 1B includes a metal portion 79B. Other configurations of the pump apparatus 1B are the same as those of the pump apparatus 1, and duplicated explanations will be omitted.

The metal portion 79B is included in an outer housing 70B. The metal portion 79B is embedded in the main plate 71 so as to be exposed at the principal surface 711 of the main plate 71.

The metal portion 79B is shaped like a flat plate and is buried in the main plate 71 of the outer housing 70B using, for example, insert molding.

Accordingly, the main plate 71 has the metal portion 79B at the principal surface 711. Accordingly, as is the case for the pump apparatus 1, the pump apparatus 1B can reduce the likelihood of the adhesive sheet 80 absorbing water, thereby reducing the deterioration of the adhesion between the principal surface 711 and the adhesive sheet 80.

Fourth Embodiment

Figure 5:
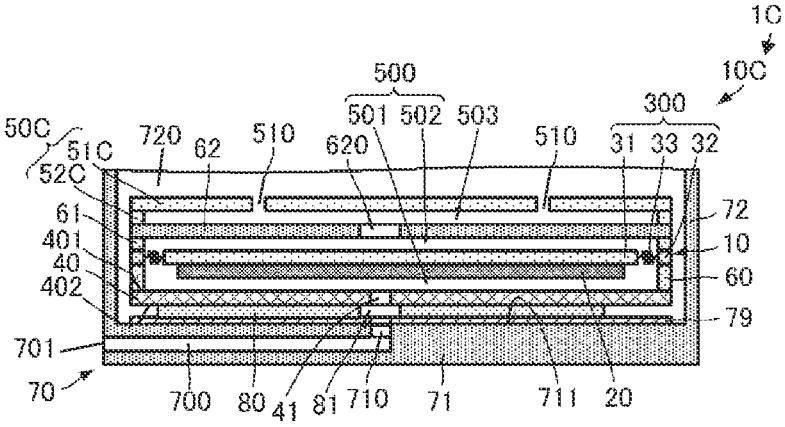
FIG. 5 is a cross-sectional side view illustrating a structure of a pump apparatus according to a fourth embodiment of the present disclosure.

A pump apparatus according to a fourth embodiment of the present disclosure will be described with reference to the drawings. FIG. 5 is a cross-sectional side view illustrating a structure of the pump apparatus according to the fourth embodiment of the present disclosure.

As illustrated in FIG. 5, a pump apparatus 1C according to the fourth embodiment is different from the pump apparatus 1 of the first embodiment in that the pump apparatus 1C has a piezoelectric pump 10C that is configured differently.

In addition to the components included in the piezoelectric pump 10, the piezoelectric pump 10C further includes a fourth housing member 61 and a fifth housing member 62. The piezoelectric element 20 of the piezoelectric pump 10C is disposed differently from that of the piezoelectric pump 10. Moreover, a second housing member 50C is formed by combining a sixth housing member 51C and a seventh housing member 52C together.

The fourth housing member 61 is a frame having a predetermined thickness. The peripheral shape of the fourth housing member 61 is substantially the same as that of the flat-plate member 300. The fourth housing member 61 is connected to the other principal surface of the flat-plate member 300 (a surface opposite to the surface to which the third housing member 60 is connected).

The fifth housing member 62 is shaped like a flat plate. As viewed in plan, the shape of the fifth housing member 62 is substantially the same as that of the flat-plate member 300. The fifth housing member 62 has a through-hole 620. The through-hole 620 is formed substantially at the center of the fifth housing member 62 as viewed in plan.

The fifth housing member 62 is disposed on the fourth housing member 61 at the side opposite to the flat-plate member 300. The fifth housing member 62 is connected to the fourth housing member 61.

The sixth housing member 51C is shaped like a flat plate. As viewed in plan, the shape of the sixth housing member 51C is substantially the same as that of the flat-plate member 300 and that of the fifth housing member 62. The sixth housing member 51C is disposed at a side of the fifth housing member 62 opposite to the side near the flat-plate member 300. The sixth housing member 51C and the fifth housing member 62 are spaced with a predetermined gap therebetween. The sixth housing member 51C has multiple intake ports 510. The intake ports 510 are disposed at a predetermined distance away from the center of the sixth housing member 51C toward the periphery thereof.

The seventh housing member 52C is shaped like a flat plate in which a groove 503 is formed. As viewed in plan, the shape of the seventh housing member 52C is substantially the same as that of the fifth housing member 62 and that of the sixth housing member 51C. The seventh housing member 52C is disposed between the fifth housing member 62 and the sixth housing member 51C so as to be in contact with the fifth housing member 62 and the sixth housing member 51C and to connect the fifth housing member 62 and the sixth housing member 51C together. In this configuration, the groove 503 is in communication with the through-hole 620 and the intake ports 510.

The piezoelectric element 20 is disposed on the surface of the diaphragm 31 of the flat-plate member 300 at the side near the first housing member 40.

The pump apparatus 1C using the piezoelectric pump 10C configured as above can provide the same advantageous effects as those of the above-described pump apparatus 1.

In the above embodiments, the adhesive sheet 80 is configured to have an annular shape, but the adhesive sheet 80 may be shaped differently. For example, as viewed in plan, the peripheral shape of the adhesive sheet 80 may be the same as that of the piezoelectric pump 10. It is easier, however, to install the adhesive sheet 80 shaped like an annular ring because it is not necessary to consider the orientation of the adhesive sheet 80. The adhesive sheet 80 shaped like an annular ring provides the circular adhesion surface adhered to the piezoelectric pump 10 and substantially aligns the center of the adhesive sheet 80 with the center of the diaphragm 31, which reduces the directional influence on the vibration of the circular diaphragm 31 (difference in the circumferential direction).

The above-described configurations can be applied to a pump apparatus using the piezoelectric pump 10 and can be applied more effectively to a small-size pump apparatus, such as a wearable pump apparatus. The small pump apparatus is vulnerable to temperature increase due to the outer housing having a small thermal capacity. The temperature of the outer housing tends to increase and cause water evaporation. With the configurations of the present disclosure, however, the likelihood of the adhesive sheet 80 absorbing water can be reduced, which can reduce the deterioration of the adhesion between the adhesive sheet 80 and the outer housing.

1, 1A, 1B, 1C pump apparatus
10, 10C piezoelectric pump
20 piezoelectric element
31 diaphragm
32 base portion
33 support portion
40 first housing member
41 discharge port
50 second housing member
51 main plate
52 frame
51C sixth housing member
52C seventh housing member
60 third housing member
61 fourth housing member
62 fifth housing member
70, 70A, 70B outer housing
71 main plate
72 side plate
78 metal-adhesive member
79, 79A, 79B metal portion
80 adhesive sheet
81 central opening
300 flat-plate member
401, 402 principal surface
500, 501, 502 space
510 intake port
700 housing channel
701 external discharge opening
710 through-hole
711 principal surface
720 internal space

The invention claimed is:

1. A pump apparatus, comprising:
a pump having a discharge-port surface with a discharge port for a fluid;
a fixation member being fixed to the pump; and
an adhesive member adhering the discharge-port surface of the pump to the fixation member, wherein
the fixation member having a first space in which the pump is disposed,
the fixation member at least partially comprising a resin having water-containing properties,
the fixation member includes
a first main plate having
i) a first principal surface opposing the discharge-port surface of the pump and being in contact with the adhesive member, and
ii) a through-hole causing the discharge port and a space located inside of the pump to communicate with a second space positioned opposite to the first space with respect to the fixation member, and
the first principal surface is made of a metal.

2. The pump apparatus according to claim 1, wherein
the first principal surface comprises a vapor deposition film, a sputtered film or a plated film of the metal.

3. The pump apparatus according to claim 1, wherein
the first principal surface comprises a plate of the metal molded in the first main plate.

4. The pump apparatus according to claim 1, wherein
the first principal surface comprises a plate of the metal adhered to the first main plate using an adhesive having thermosetting or ultraviolet curing properties.

5. The pump apparatus according to claim 1, wherein
an area of the first principal surface is larger than an adhesion area between the adhesive member and the discharge-port surface and also larger than an adhesion area between the adhesive member and the first principal surface.

6. The pump apparatus according to claim 1, wherein
an area of the discharge-port surface is larger than the adhesion area between the adhesive member and the discharge-port surface and also larger than the adhesion area between the adhesive member and the first principal surface.

7. The pump apparatus according to claim 6, wherein
the discharge-port surface is shaped as a polygon as viewed in plan, and
the adhesive member is not adhered to corner portions of the polygon.

8. The pump apparatus according to claim 1, wherein
the adhesive member is an acrylic adhesive sheet or a silicone adhesive sheet.

9. The pump apparatus according to claim 1, wherein
the resin used in the fixation member has a percentage of water absorption of 0.15 or more.

10. The pump apparatus according to claim 2, wherein
an area of the first principal surface is larger than an adhesion area between the adhesive member and the discharge-port surface and also larger than an adhesion area between the adhesive member and the first principal surface.

11. The pump apparatus according to claim 3, wherein
an area of the first principal surface is larger than an adhesion area between the adhesive member and the discharge-port surface and also larger than an adhesion area between the adhesive member and the first principal surface.

12. The pump apparatus according to claim 4, wherein
an area of the first principal surface is larger than an adhesion area between the adhesive member and the discharge-port surface and also larger than an adhesion area between the adhesive member and the first principal surface.

13. The pump apparatus according to claim 2, wherein
an area of the discharge-port surface is larger than the adhesion area between the adhesive member and the discharge-port surface and also larger than the adhesion area between the adhesive member and the first principal surface.

14. The pump apparatus according to claim 3, wherein
an area of the discharge-port surface is larger than the adhesion area between the adhesive member and the discharge-port surface and also larger than the adhesion area between the adhesive member and the first principal surface.

15. The pump apparatus according to claim 4, wherein an area of the discharge-port surface is larger than the adhesion area between the adhesive member and the discharge-port surface and also larger than the adhesion area between the adhesive member and the first principal surface.

16. The pump apparatus according to claim 5, wherein an area of the discharge-port surface is larger than the adhesion area between the adhesive member and the discharge-port surface and also larger than the adhesion area between the adhesive member and the first principal surface.

17. The pump apparatus according to claim 2, wherein the adhesive member is an acrylic adhesive sheet or a silicone adhesive sheet.

18. The pump apparatus according to claim 3, wherein the adhesive member is an acrylic adhesive sheet or a silicone adhesive sheet.

19. The pump apparatus according to claim 4, wherein the adhesive member is an acrylic adhesive sheet or a silicone adhesive sheet.

20. The pump apparatus according to claim 5, wherein the adhesive member is an acrylic adhesive sheet or a silicone adhesive sheet.

* * * * *